United States Patent [19]
Ramanarayanan et al.
[11] 4,402,746
[45] Sep. 6, 1983

[54] ALUMINA-YTTRIA MIXED OXIDES IN DISPERSION STRENGTHENED HIGH TEMPERATURE ALLOYS

[75] Inventors: Trikur A. Ramanarayanan, Somerset; Ruzica Petkovic-Luton, Englewood, both of N.J.; Raghavan Ayer, Stamford, Conn.

[73] Assignee: Exxon Research and Engineering Co., Florham Park, N.J.

[21] Appl. No.: 363,898

[22] Filed: Mar. 31, 1982

[51] Int. Cl.[3] ..... C22C 1/05
[52] U.S. Cl. ..... 75/252; 75/234; 148/11.5 P
[58] Field of Search ..... 75/0.5 R, 0.5 B, 0.5 BA, 75/0.5 BB, 0.5 BC, 252, 234; 148/11.5 P

[56] References Cited

U.S. PATENT DOCUMENTS

| | | | |
|---|---|---|---|
| 3,591,362 | 7/1971 | Benjamin | 75/0.5 BA |
| 3,623,849 | 11/1971 | Benjamin | 29/182.8 |
| 3,723,092 | 3/1973 | Benjamin | 75/0.5 R |
| 3,738,817 | 6/1973 | Benjamin | 29/182.5 |
| 3,778,249 | 12/1973 | Benjamin | 75/0.5 BC |
| 3,785,801 | 1/1974 | Benjamin | 75/0.5 BC |
| 3,809,545 | 5/1974 | Benjamin | 75/0.5 R |
| 3,865,572 | 2/1975 | Fisher et al. | 75/0.5 R |
| 3,877,930 | 4/1975 | Volin | 75/0.5 R |

*Primary Examiner*—W. Stallard
*Attorney, Agent, or Firm*—Henry E. Naylor

[57] ABSTRACT

Disclosed are oxide dispersion strengthened high temperature alloy compositions which contain as the dispersoid one or more alumina-yttria mixed-oxides selected from the group consisting of $Al_2O_3.2Y_2O_3$, $Al_2O_3.Y_2O_3$, and $5Al_2O_3.3Y_2O_3$.

22 Claims, No Drawings

ALUMINA-YTTRIA MIXED OXIDES IN DISPERSION STRENGTHENED HIGH TEMPERATURE ALLOYS

BACKGROUND OF THE INVENTION

This invention relates to oxide dispersion strengthened alloy compositions which can be employed in high temperature services.

A considerable amount of research has been conducted in recent years to develop alloys which can withstand higher and higher temperatures and environments which are increasingly reactive. Such reactive environments include sulfurizing, carburizing, and oxidizing environments, all of which are known to significantly affect plant performance and efficiency for many industrial processes. It is known that the high temperature service properties of iron, nickel, and cobalt based alloys can be substantially improved by dispersion strengthening. Dispersion strengthening involves the uniform dissemination of a large number of discrete sub-micron sized refractory particles throughout the metal matrix. The refractory particles, generally oxides, serve to stabilize the matrix microstructure at elevated temperatures, thereby increasing its tensile strength and stress rupture life at elevated temperatures. Oxide dispersion strengthened alloys which contain aluminum are particularly useful in high temperature applications where reactive environments are encountered because the aluminum reacts with oxygen to form a protective aluminum oxide scale on the surface of the alloy.

Various powder metallurgy techniques are known for preparing such oxide dispersion strengthened alloys which usually include mechanically alloying the oxide particles with the powder metal matrix thereby forming agglomerates in order to achieve a uniform distribution of the oxide particles in the powder matrix. The agglomerates are then usually consolidated and worked to the desired end product. The high temperature mechanical properties of the resulting alloy product are critically dependent on the presence of stable submicron-size inert oxide particles in the matrix. In addition, the high temperature resistance to reactive environments is, to a large degree, dependent on the formation of an aluminum oxide or chromium oxide scale on the surface of the alloy product. The adherence of such oxide scales is generally improved by the presence of the dispersed oxide particles.

The dispersoids of the type employed in the alloys which are of interest herein are those oxide particles having a negative free energy of formation at 1000° C. of at least as great as that of aluminum oxide, in particular yttria. Oxide dispersion strengthened alloys containing oxide particles such as yttria and aluminum which are presently commercially available suffer from serious quality problems. These problems can usually be attributed to a loss of homogeneity of the material because of interaction of aluminum, oxygen, and yttria resulting in the formation of various alumina-yttria mixed oxides. Oxygen is present either during the preparation of the oxide dispersion strengthened alloy or during high temperature service. This interaction results in a coarsening of the yttria particles and depletion of some of the aluminum which would otherwise be available for the formation of a protective aluminum oxide scale on the surface of the alloy product when aluminum is the primary oxide former.

The present invention overcomes these problems by employing one or more alumina-yttria mixed oxides instead of yttria as the dispersoid.

SUMMARY OF THE INVENTION

In accordance with the present invention there is provided an improved iron, nickel, or cobalt based aluminum-containing oxide dispersion strengthened alloy product. The oxides which are dispersed in these alloys are one or more of the alumina-yttria mixed oxides selected from the group consisting of $Al_2O_3.2Y_2O_3$ (YAM), $Al_2O_3.Y_2O_3$ (YAP), and $5Al_2O_3.3Y_2O_3$ (YAG).

Also provided in accordance with the present invention is a mechanical alloy composition comprised of (a) from 1 wt.% to 10 wt.% of one or more of the aforementioned alumina-yttria mixed oxides; and (b) a powder metal matrix containing at least 50 wt.% iron, nickel or cobalt.

Up to about 30 wt.% chromium may also be included in the alloy compositions of the present invention.

There is also provided in accordance with the present invention, a process for producing improved oxide dispersion strengthened products. The process comprises the substitution of particles one or more of the aforementioned alumina-yttria mixed oxides for oxide particles having a negative free energy of formation of 1000° C. of at least as great as that of aluminum oxide in a process in which the oxide particles would conventionally be mechanically alloyed and fabricated into an iron, nickel or cobalt based dispersion strengthened alloy product.

DETAILED DESCRIPTION OF THE INVENTION

Oxide dispersion strengthened alloy compositions which are the subject of the present invention are those which contain aluminum and would also conventionally contain oxide particles having a negative free energy of formation of 1000° C. of at least as great as that of aluminum oxide. Yttria and thoria are oxides of particular interest. By practice of the present invention, one or more alumina-yttria mixed oxides are employed in place of the aforesaidd oxide particles.

Alumina-yttria mixed oxides which may be employed in the practice of the present invention include $Al_2O_3.2Y_2O_3$, $Al_2O_3.Y_2O_3$, and $5Al_2O_3.3Y_2O_3$. Although any combination of these mixed oxides may be employed as the dispersoid herein, it is preferred to employ only $5Al_2O_3.3Y_2O_3$. When only $5Al_2O_3.3Y_2O_3$ is employed as the dispersoid in the alloy materials of the present invention, the dispersoid particles will not undergo coarsening during processing or during high temperature service. Furthermore, by employing only $5Al_2O_3.3Y_2O_3$ as the dispersoid, aluminum from the metal matrix will not be depleted and will be completely available for the formation of a protective oxide scale on the surface of the alloy product when aluminum is the primary oxide former. If a certain degree of dispersoid coarsening can be tolerated, then a predetermined amount of one or more of $Y_2O_3$, $Al_2O_3.2Y_2O_3$, or $Al_2O_3.Y_2O_3$ may be employed. $Al_2O_3.2Y_2O_3$, $Al_2O_3.Y_2O_3$, as well as yttria, will react with aluminum and oxygen at elevated temperatures thereby forming another discrete mixed oxide but one which is coarser and has a greater ratio of alumina to yttria. That is, $Y_2O_3$, as well as other oxide dispersoids will react with aluminum and oxygen to form $Al_2O_3.2Y_2O_3$ which will further react with aluminum and oxygen to form $Al_2O_3$.$Y_2O_3$ etc., until the final mixed-oxide, $5Al_2O_3.3Y_2O_3$ is formed. The particle size of each new mixed-oxide is, of course, greater than that of the oxide or mixed-oxide from which it is evolved. It is for the reason that it is preferred to employ only $5Al_2O_3.3Y_2O_3$ as the dispersoid in the alloys of the present invention.

The weight fraction of the alumina-yttria mixed oxide which is employed herein can be determined by strength considerations. If only the preferred mixed oxide, $5Al_2O_3.3Y_2O_3$ is employed, the volume content of that mixed oxide can be increased significantly without loss of aluminum from the matrix because there is virtually no interaction between $5Al_2O_3.3Y_2O_3$ and the aluminum of the matrix. Thus, the resulting alloy product does not suffer a loss of high temperature corrosion resistance. The precise amount of each alumina-yttria oxide employed herein may be determined by routine experimentation by one having ordinary skill in the art and will not be discussed in further detail.

The alumina-yttria dispersoid particles employed herein will preferably have a particle size of about 50 angstroms (A) to about 5000 A., more preferably about 100 A. to about 1000 A., and have average interparticle spacings of about 500 A. to about 2500 A., more preferably, about 600 A. to about 1800 A. The ingredients which will comprise the metal powder for the matrix should be ground to pass a 200 mesh screen if not smaller.

Oxide dispersion strengthened alloys which are the subject of the present invention are those which are iron, nickel, or cobalt based and which contain from about 0.3 wt.% to about 10 wt.% aluminum, preferably from about 4 wt.% to about 6 wt.% aluminum. The aluminum-yttria mixed oxide will be employed in concentrations ranging from about 1 wt.% to about 10 wt.%, preferably about 1 to about 3 wt.%. The term iron, nickel, or cobalt based means that the resulting alloy composition contains iron, nickel, or cobalt as the major component. The alloys of the present invention may also contain up to about 30 wt.% chromium. All weight percents used herein are based on the total weight of the alloy composition.

In the practice of the present invention, particles of discrete alumina-yttria mixed oxide, preferably $5Al_2O_3.3Y_2O_3$, are employed as the dispersoid such that the final alloy material contains only the amount of dispersoid phase that is required for strengthening purposes and no change in particulate volume, or coarsening, is introduced in the processing of the alloy material or in high temperature service.

Any conventional method used to prepare oxide dispersion strengthened alloy materials may be used in the practice of the present invention. Generally the oxide dispersion strengthened alloys are prepared by first mechanically alloying a powder metal matrix and oxide particles. One non-limiting mechanical alloying process which may be employed in the practice of the present invention is the process disclosed in U.S. Pat. No. 3,591,362 to the International Nickel Company, which is incorporated herein by reference. In that patent the constituent metal particles of the starting powder charge are integrated together into dense composite particles without melting any of the constituents; this is done by dry milling the powder, usually in the presence of grinding media, e.g. metal or ceramic balls, in order to apply to the powder charge, mechanical energy in the form of a plurality of repeatedly applied high energy, compressive forces. Such high energy forces result in the fracture, or comminution of the original powder constituents and the welding together of the fragments so produced, as well as the repeated fracture and rewelding of the welded fragments, thereby bringing about a substantially complete codissemination of the fragments of the various constituents of the starting powder. The mechanically alloyed composite powder particles produced in this manner are characterized metallographically by cohesive internal structures in which the constituents are intimately united to provide an interdispersion of comminuted fragments of the starting constituents.

Another mechanical alloying process which may be employed herein is the process disclosed in U.S. Pat. No. 4,010,024 to Special Metals Corp. which is also incorporated herein by reference. Such a process includes the steps of: (a) admixing metal powder and oxide particles having a negative free energy of formation at 1000° C. of at least as great as that of aluminum oxide, and (b) milling the mixture in an oxygen-containing atmosphere for a period of time which is sufficient to effect a substantially uniform dispersion of the oxide particles in the metal powder. The oxygen-containing atmosphere is one which contains sufficient oxygen to substantially preclude welding of the particles of the metallic powder to other such particles. The dispersion strengthened powder is then heat treated to remove excess oxygen.

In general, the mechanical alloying process may be performed with various types of equipment. Nonlimiting examples of such equipment include a stirred ball mill, a shaker mill, a vibratory ball mill, a planetary ball mill, as well as certain other ball mills.

After the metal and oxide ingredients are mechanically alloyed, they are generally hot consolidated, such as by extrusion, to a substantially completely dense body. After consolidation, various heat treatments can be employed where the consolidated alloy is hot and/or cold worked into a desired shape.

The following examples serve to more fully describe the present invention. It is understood that these examples in no way serve to limit the true scope of the invention, but rather, are presented for illustrative purposes.

COMPARATIVE EXAMPLE

Four coupons of MA956, an oxide dispersion strengthened alloy commercially available from INCO which is reportedly prepared by mechanically alloying a powder composition comprised of about 20 wt.% chromium, 4.5 wt.% aluminum, 0.5 wt.% titanium, 0.5 wt.% yttria, and the balance being iron, were heat treated at various temperatures in air. Five samples from each coupon were taken after exposure for 100 hours at predetermined temperatures. The samples were inspected by use of an analytical transmission electron microscope to determine the average size of the oxide dispersoid, in this case yttria. Table I below sets forth the average size of the oxide dispersoid particles from the samples taken at temperatures referenced in Table I.

TABLE I

| Average Size, in Angstroms, of Dispersoid Particles | | | |
|---|---|---|---|
| As Received | 1100° C. | 1200° C. | 1300° C. |
| 190 | 192 | 200 | 290 |

The data in Table I clearly show that the dispersoid (yttria) particles increase in size during high temperature processing, although the particles will also increase in size during high temperature service as well. It has been found by the inventors herein that this increase in size is the result of the reaction of yttria with aluminum and oxygen, thereby resulting in the formation of various alumina-yttria mixed oxides having a particle size greater than that of the original yttria particles. These mixed oxides were analyzed and were found to be primarily $Al_2O_3.Y_2O_3$, which of course were greater in particle size than the original yttria dispersoid particles. If the coupons were heat treated at elevated temperatures for long enough periods of time, it would be found that most of the mixed oxide particles present in the alloy would be $5Al_2O_3.3Y_2O_3$.

Furthermore, because of the reaction of aluminum and oxygen with yttria at elevated temperatures, a significant portion of the aluminum of the matrix has been depleted and is no longer available to contribute to the formation of an aluminum oxide scale on the surface of the alloy article.

EXAMPLE 1

Four coupons of an oxide dispersion strengthened alloy composition similar to MA956 but prepared by mechanically alloying and consolidating by hot extrusion of a powder composition comprised of about 20 wt.% chromium, 4.5 wt.% aluminum, 0.5 wt.% titanium, 0.5 wt.% $5Al_2O_3.3Y_2O_3$, and the balance being iron, were heat treated at the same temperatures as the coupons of the above comparative example. Five samples of each coupon were taken after exposure for 100 hours at the various temperatures and also inspected as in the above example. Table II below sets forth the average size of the oxide dispersoid particles from the samples taken at the various temperatures.

TABLE II

| Average Size, in Angstroms, of Dispersoid Particles | | | |
|---|---|---|---|
| As Received | 1100° C. | 1200° C. | 1300° C. |
| 1570 | 1390 | 1575 | 1225 |

The above Table II shows that there is no tendency for the $5Al_2O_3.3Y_2O_3$ mixed-oxide dispersoid particles to increase in size when the alloy in which they are contained is subjected to elevated temperatures, this is because the $5Al_2O_3.3Y_2O_3$ dispersoid particles cannot react with aluminum and oxygen. Consequently, these dispersoid particles do not coarsen and create microstructural and chemical instability in the alloy material. Aluminum is not depleted from the matrix but is fully available to contribute to the formation of an aluminum oxide scale on the surface of the alloy material.

EXAMPLES 2–4

Samples of three different commercially available yttria dispersion strengthened materials were analyzed using an analytical transmission electron microscope to determine the type dispersoid particles present as well as their size in angstroms. Table III below sets forth the three alloys analyzed, the composition of the powder each was mechanically alloyed from, and the supplier of each.

TABLE III

| | Composition (wt. %) | | | | | | |
|---|---|---|---|---|---|---|---|
| Alloy | Fe | Ni | Cr | Al | Ti | $Y_2O_3$ | Supplier |
| X-127 | — | 78.5 | 16.0 | 4.5 | — | 1.0 | Special Metals Corp. |
| MA754 | — | 79.2 | 20.0 | 0.3 | 0.5 | 0.6 | INCO |
| MA956 | 75 | — | 20.0 | 4.5 | 0.5 | 0.5 | INCO |

The samples were prepared by conventional techniques for analyzing with an analytical electron microscope. X-ray microanalysis and microdiffraction analysis showed that besides aluminum oxide, four distinct alumina-yttria mixed-oxides were also present. The compositions as by x-ray microanalysis and crystal structure of the alumina-ytttria oxide and the alloys in which the oxides occurred are shown in Table IV below.

TABLE IV

| Dispersoid Particle | Composition at % Al | Y | Crystal Structure | Alloys Containing Particles | mean Particle Size (± A) |
|---|---|---|---|---|---|
| YAG | 64 | 36 | Cubic | x-127 | 2864 (± 2023) |
| $5Al_2O_3.3Y_2O_3$ | | | | MA754 | 449 (± 115) |
| YAP | 50 | 50 | Orthohombic | x-127 | 1134 (± 986) |
| $Al_2O_3.Y_2O_3$ | | | | MA754 | 373 (± 124) |
| | | | | MA956 | 390 (± 130) |
| YAP' | 50 | 50 | Monoclinic | x-127 | same as YAP |
| $Al_2O_3.Y_2O_3$ | | | | MA754 | same as YAP |
| | | | | MA956 | same as YAP |
| YAM | 33 | 67 | Monoclinic | x-127 | 959 (± 599) |
| $Al_2O_3.2Y_2O_3$ | | | | MA754 | 312 (± 143) |

These examples illustrate that oxide dispersion strengthened alloys mechanically alloyed from a metal powder matrix containing yttria as the dispersoid contained various alumina-yttria mixed-oxides after processing. These mixed oxides result from the reaction of aluminum and oxygen with yttria and grow coarser as yttria passes through the YAM and YAP stage to YAG.

What is claimed is:

1. In a method for producing an oxide dispersion strengthened high temperature alloy from a metal powder mixture which contains about 0 to 30 wt.% chromium, about 0 to 3 wt.% titanium, about 0.3 wt.% to 10 wt.% aluminum, about 0.3 wt.% to 10 wt.% oxide dispersoid particles having a negative free energy of formation at 1000° C. of at least as great as that of aluminum oxide, and as a major component a metal selected from the group consisting of iron, nickel and cobalt, which method comprises the steps of, (a) mechanically alloying the metal powder mixture, and, (b) hot consolidating the mechanically alloyed mixture; the improvement which commprises the replacement of all or a fraction of the dispersoid particles with one or more alumina-yttria mixed-oxides selected from the group consisting of $Al_2O_3.2Y_2O_3$, $Al_2O_3.Y_2O_3$, and $5Al_2O_3.3Y_2O_3$.

2. The method of claim 1 wherein the dispersoid is yttria.

3. The method of claim 1 or 2 wherein iron is the major component.

4. The method of claim 1 or 2 wherein nickel is the major component.

5. The method of claim 3 wherein all of the original dispersoid is replaced with one or more of the alumina-yttria mixed-oxides.

6. The method of claim 4 wherein all of the original dispersoid is replaced with one or more of the alumina-yttria mixed oxides.

7. The method of claim 3 wherein all of the original dispersoid is replaced with $5Al_2O_3.3Y_2O_3$.

8. The method of claim 4 wherein all of the original dispersoid is replaced with $5Al_2O_3.3Y_2O_3$.

9. The method of claim 3 wherein about 4 wt.% to 6 wt.% aluminum is present in the metal powder mixture.

10. The method of claim 4 wherein about 4 wt.% to 6 wt.% aluminum is present in the metal powder mixture.

11. In an oxide dispersion strengthened high temperature alloy which is mechanically alloyed and consolidated from a metal powder mixture containing about 0 to 30 wt.% chromium, about 0 to 3 wt.% titanium, about 0.3 wt.% to 10 wt.% aluminum, about 0.3 to 10 wt.% oxide dispersoid particles having a negative free energy of formation at 1000° C. of at least as great as that of aluminum oxide, and as a major component a metal selected from the group consisting of iron, nickel, and cobalt; the improvement which comprises particles of one or more alumina-yttria mixed-oxides selected from the group consisting of $Al_2O_3.2Y_2O_3$, $Al_2O_3.Y_2O_3$, and $5Al_2O_3.3Y_2O_3$ being present in place of all or a fraction of the original dispersoid.

12. The alloy of claim 11 wherein the original dispersoid is yttria.

13. The alloy of claim 11 wherein iron is the major component.

14. The alloy of claim 11 wherein nickel is the major component.

15. The alloy of claim 13 wherein one or more of the alumina-yttria mixed-oxides are present in place of all of the original dispersoid.

16. The alloy of claim 14 wherein one or more of the alumina-yttria mixed oxides are present in place of all of the original dispersoid.

17. The alloy of claim 13 wherein only the mixed-oxide $5Al_2O_3.3Y_2O_3$ is present in place of all of the original dispersoid.

18. The alloy of claim 14 wherein only the mixed-oxide $5Al_2O_3.3Y_2O_3$ is present in place of all of the original dispersoid.

19. The alloy of claim 13 wherein about 4 wt.% to 6 wt.% aluminum is present.

20. The alloy of claim 14 wherein about 4 wt.% to 6 wt.% aluminum is present.

21. An oxide dispersoid strengthened alloy comprised of about 75 wt.% to 80 wt.% nickel, about 15 wt.% to 20 wt.% chromium, about 0.3 wt.% to 5 wt.% aluminum, from 0 to 1 wt.% titanium and about 0.5 wt.% to 1.5 wt.% $5Al_2O_3.3Y_2O_3$.

22. An oxide dispersoid strengthened alloy comprised of about 70 wt.% to 80 wt.% iron, about 18 wt.% to 22 wt.% chromium, about 0.3 wt.% to 5 wt.% aluminum, about 0.3 wt.% to 0.6 wt.% titanium and about 0.3 wt.% to about 1 wt.% $5Al_2O_3.3Y_2O_3$.

* * * * *